US009249599B2

(12) United States Patent
Berger et al.

(10) Patent No.: US 9,249,599 B2
(45) Date of Patent: Feb. 2, 2016

(54) DOOR LEVER ASSEMBLY

(71) Applicant: SECURITECH GROUP, INC., Maspeth, NY (US)

(72) Inventors: Mark J. Berger, New York, NY (US); Jeffrey Regen, Riverhead, NY (US)

(73) Assignee: Securitech Group, Inc., Maspeth, NY (US)

( * ) Notice: Subject to any disclaimer, the term of this patent is extended or adjusted under 35 U.S.C. 154(b) by 110 days.

(21) Appl. No.: 13/850,768

(22) Filed: Mar. 26, 2013

(65) Prior Publication Data

US 2013/0270844 A1 Oct. 17, 2013

Related U.S. Application Data

(60) Provisional application No. 61/615,542, filed on Mar. 26, 2012.

(51) Int. Cl.
*E05B 1/00* (2006.01)
*E05B 15/02* (2006.01)

(52) U.S. Cl.
CPC ..... *E05B 1/003* (2013.01); *E05B 15/02* (2013.01); *Y10T 292/57* (2015.04)

(58) Field of Classification Search
USPC ..... 292/336.3, 347, 348, 354, 356, 357, 292/DIG. 65; 16/412, 414, 417, 418, 430; 70/91, 95–100, 208–210, 224; 49/502
See application file for complete search history.

(56) References Cited

U.S. PATENT DOCUMENTS

| | | | | | |
|---|---|---|---|---|---|
| 26,809 | A * | 1/1860 | Belfield | 292/126 |
| 352,213 | A * | 11/1886 | White | 70/97 |
| 633,291 | A * | 9/1899 | Newell | 70/99 |
| 646,233 | A * | 3/1900 | Newell | 70/99 |
| 1,090,305 | A * | 3/1914 | Hoffman | 70/100 |
| 1,933,865 | A * | 11/1933 | Martinek | 70/97 |
| 3,433,036 | A * | 3/1969 | Brasseur | 70/99 |
| 3,433,519 | A * | 3/1969 | Brasseur | 292/336.3 |
| 5,303,965 | A * | 4/1994 | Meehan | 292/336.3 |
| 7,013,687 | B2 * | 3/2006 | Shedd et al. | 70/99 |
| D680,849 | S * | 4/2013 | Berger et al. | D8/308 |
| 8,430,436 | B2 * | 4/2013 | Shilts | 292/347 |
| D690,577 | S * | 10/2013 | Eller et al. | D8/331 |
| 8,584,494 | B2 * | 11/2013 | Salvatore et al. | 70/210 |
| 2011/0120024 | A1 * | 5/2011 | Shilts | 49/506 |
| 2014/0311194 | A1 * | 10/2014 | Berger et al. | 70/101 |

* cited by examiner

*Primary Examiner* — Alyson M Merlino
(74) *Attorney, Agent, or Firm* — Abelman, Frayne & Schwab

(57) ABSTRACT

A lever and mounting plate combination attachable to the exposed vertical surface of a door that includes a latch assembly with a spindle extending horizontally outward from the vertical surface, the lever and mounting plate combination including a main plate mountable onto the door's exposed surface and having a window-like opening extending completely through the plate, a lever having a base part which is coupleable to the spindle and pivotable therewith and has an exposed outer part, and a lever plate fixed to the base part of the lever and pivotable with though lever and with the spindle when it is coupled to the lever, the lever plate closely underlies and contacts said inner surface of the main plate while at all times covering the window, the lever being engagable by a user to rotate the lever plate and simultaneously rotate the spindle to open the door.

9 Claims, 3 Drawing Sheets

FIG. 5
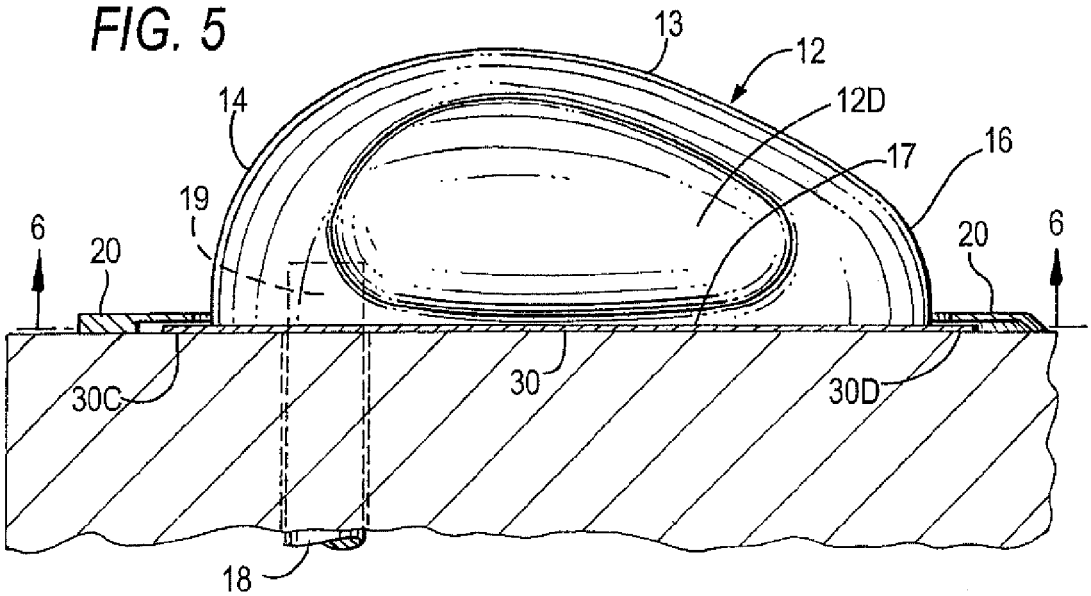
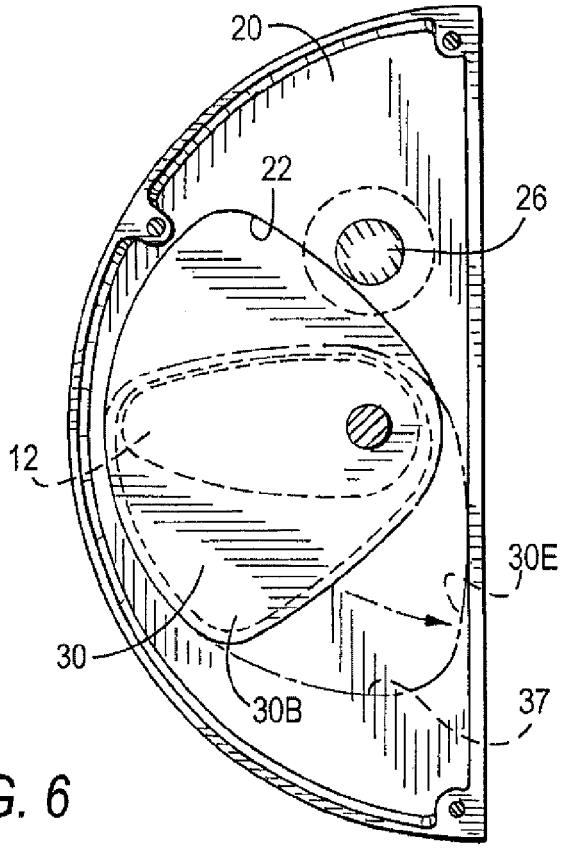
FIG. 6

DOOR LEVER ASSEMBLY

RELATED CASE

This application claims priority under 35 U.S.C. §119, 120 based upon applicant's Provisional Patent Application, Ser. No. 61/615,542, having filing date of Mar. 26, 2012.

BACKGROUND

1. Field of the Invention

This invention is in the field of door levers for security doors and particularly for door levers for doors of residential rooms in mental institutions where patients reside.

2. Prior Art

This invention relates to a serious problem where certain patients in behavioral health care facilities or psychiatric institutions try to commit suicide by hanging themselves with a cord or other ligature form looped over the top of a door and secured to a handle or knob of the door to the patient's room. This invention relates to methods and apparatus seeking to prevent such attempted suicides. Reasons for such behavior are complex and not the subject of the present invention; however, significant numbers of attempts do occur, and significant numbers of patients are committed into these institutions for the very reason that they are known to be candidates for suicide attempts. These institutions are supposed to be environments for treatment of these and other problems and for prevention of patients from achieving suicide.

While the methods employed for the attempted suicides vary with the available environment and creativity of the patients, the present invention is concerned with attempts by hanging with a cord, belt or other item with the near or proximal portion of the cord wrapped around the door knob, lever or other handle of a door. The cord is then draped over the top of the door and the distal or remote end of the cord, belt, twisted bed sheet or other item on the interior side of the door is formed into the suicidal noose.

In typical psychiatric institutions the patients' activities, as regards personal safety and behavior in general, are monitored carefully by staff; however, it is also common for patients to have private rooms with unlocked doors for them to come and go generally as they please. It is in these kinds of situations where a patient has periods of relative privacy and domain over his or her door, when a suicide attempt can be made without immediate awareness of institution staff and with enough time for the suicide to be successful before staff action can be taken. For various reasons there are surprisingly high numbers of attempted and successful suicides in psychiatric institutions that are not generally publicized or known, but administrators of these institutions are quite aware and concerned. The present invention addresses these tragedies and presents a practical apparatus believed to be able to significantly reduce the problem on a nationwide basis.

Attempts have been made to prevent or defeat the above-described efforts at suicide by hanging, by designing the doorknob such that any cord will not securely engage or connect to the doorknob, and thus will slide off and the opposite end of the cord cannot support any body weight and suicide will be defeated.

Conventional door levers comprise an elongated handle which pivots about an axis near one end of the lever. With such a design it is obviously quite easy to loop the remote end of a cord around the shaft of the lever and around the elongated lever itself. One proposed solution, such as seen in applicant's own pending non-provisional application Ser. No. 12/590,135 incorporated herein by reference, includes a partially conical form of the lever in the area of the pivot and a downward tapered shape of the handle portion of the lever. This design has been partially successful to reduce success in suicide attempts where a ligature is draped over the top of a door and extends down to the lever. However, there remain some situations where the ligature can become wedged in the area of the pivot or shaft connection at the base of the handle, namely wedged between the bottom surface of the handle and the surface of the door.

The present invention provides a totally new design of door lever which will prevent the latest nuance of possible wedging a ligature in the door handle assembly.

SUMMARY AND OBJECTS OF THE NEW INVENTION

A first object of the present invention is to provide a new design of exit door lever which does not allow the end of a ligature to be secured to the door lever.

A further object is to provide a new door lever where there is no gap or access between the base of the lever and the surface of the door into which a ligature could be wedged.

An additional object is to provide a new door lever where there is no gap between the bottom of the escutcheon or collar and the surface of the door.

Another object is to provide a new design of exit door leer where the handle and stem portions comprise a smooth top elongated mouse-like shape which has an elongated smooth hump top surface, and a flat bottom surface, such that no portion of the top or side surfaces can be used to engage any ligature because such ligature would simply slide off.

A further object is to eliminate the conventional gap between the bottom surface of the lever or mouse shape in this case, and the door surface, where a thin ligature could be wedged.

An additional object is to eliminate said conventional gap by securing flat plate the bottom surface of the stem of the lever, where the flat plat plate has area greater than that of the stem portion and pivots with the stem.

A still further object is to provide a door lever as defined above where the pivot plate underlies the mounting plate and the lever is pivotable within an aperture in the main plate while the pivot plate under les and coses said aperture.

The new lever assembly comprises the mouse-like shaped handle and an attached pivot plate secured below the bottom surface of the mouse handle as described above, and a larger face plate below the pivot plate, the larger face plate being secured to the door surface and the face plate has an aperture therethrough or window, and the mouse handle portion extends upward through that window while the pivot plate is at all times below the face plate and closely underlying the face plate. The mouse handle can be pivoted and moves from a typical horizontal three o'clock latched position to an activated downward inclined position. During all pivoting motions the pivot plate remains closely underlying the face plate surface so that there is no visible or viable gap into which a ligature could be stuffed or wedged.

The mouse shape lever itself has all rounded and tapered surfaces so that any ligature in contact with it could only slide off and thus could not be secured to this lever as a anchor to support the ligature's opposite end formed as a noose. The mouse lever is somewhat elongated to be readily grasped by persons hand and pivoted door twisted downward in the normal manner to open the door. A pivoting movement of about 15 to 20° is usually sufficient to activate the latch mechanism for opening the door.

The face plate is typically a thin but strong rigid metal of thickness about one eighth inch, and the pivot plate is a similar thin metal plate which is rigid and strong enough to resist any attempts at dismantling or deforming it. Various conventional metal or plastic materials may be selected for their characteristics of strength, appearance and durability.

In a conventional manner the key lock cylinder is mounted on and extends through the face plate, being positioned generally near the lever, and in this case is slightly above the lever for access and visibility. This lock cylinder would extend through a hole in the face plate and thence into the main body of the door to the locking mechanism.

Various embodiments of the present invention are described as follows:

1. A lever and mounting plate combination attachable to the exposed vertical surface of a door that includes a latch assembly with a spindle extending horizontally outward from said vertical surface, said lever and mounting plate combination comprising:

a. a main plate having top, bottom and opposite side edges and and inner face mountable onto said door's exposed surface and an outer face, each of said faces defining an area A, said plate having a window-like opening of area B<A inward of said top, bottom and side edges and extending completely through said plate, b. a lever having a base part defining an area C<B which is coupleable to said spindle and pivotable therewith and has an exposed outer part, and c. a lever plate fixed to said base part of said lever and pivotable with said lever and with said spindle when it is coupled to said lever, said lever plate having area D>B which closely underlies and contacts said inner surface of said main plate while at all times covering said window, said lever being engagable by a user to rotate said lever and said lever plate and simultaneously rotate said spindle to open said door.

2. A lever and mounting plate combination according to the embodiment 1 above wherein said lever
is pivotable in both counterclockwise and clockwise directions to and from a generally horizontal latched position.

3. A lever and mounting plate combination according to the embodiment 1 above wherein said
Window-like opening has a generally trapezoidal shape.

4. A lever and mounting plate combination according to the embodiment 3 above wherein said
generally trapezoidal shape has convex top and bottom edges.

5. A lever and mounting plate combination according to the embodiment 1 above wherein said lever
shape that simulates a computer mouse with a convex rounded head end and a convex rounded tail end which is smaller than said head end, and has converging sides. Between said head and tail ends.

6. A lever and mounting plate combination according to the embodiment 5 above wherein said lever has a curved upper surface that tapers from head to tail in both side elevation views and in the top plan view.

7. A lever and mounting plate combination according to the embodiment 6 above wherein said lever
has an exposed surface side portion with elongated inward recesses adapted to receive as user's thumb and finger tips for ease of pivoting said lever.

8. A lever and mounting plate combination according to the embodiment 1 above further comprising
an aperture in said main plate through which is insertable a key lock cylinder.

9. A lever and mounting plate combination according to the embodiment 1 above wherein said lever is elongated with opposite head and tail ends and with said head end adapted to couple with said spindle.

BRIEF DESCRIPTION OF THE DRAWINGS

FIG. 5 is a fragmentary sectional view taken along lines 5-5 in FIG. 3 showing the new lever assembly mounted to a door, and FIG. 6 is a bottom plan view of the new lever assembly taken along line 6-6 in FIG. 5 showing the bottom surfaces of the pivot plate and of the main plate.

DETAILED DESCRIPTION OF THE PREFERRED EMBODIMENT

Figure 1:
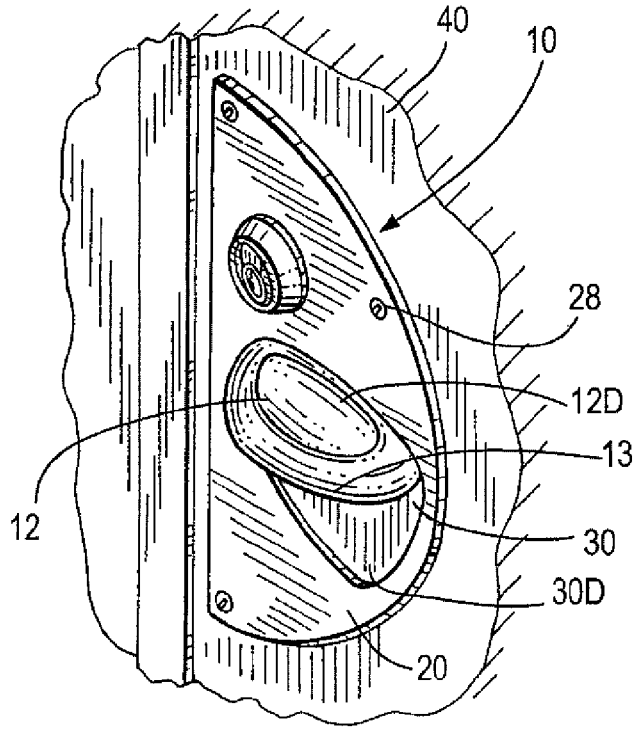
FIG. 1 is a fragmentary top and front perspective view of the new lock assembly secured to the face surface of a door.
Figure 2:
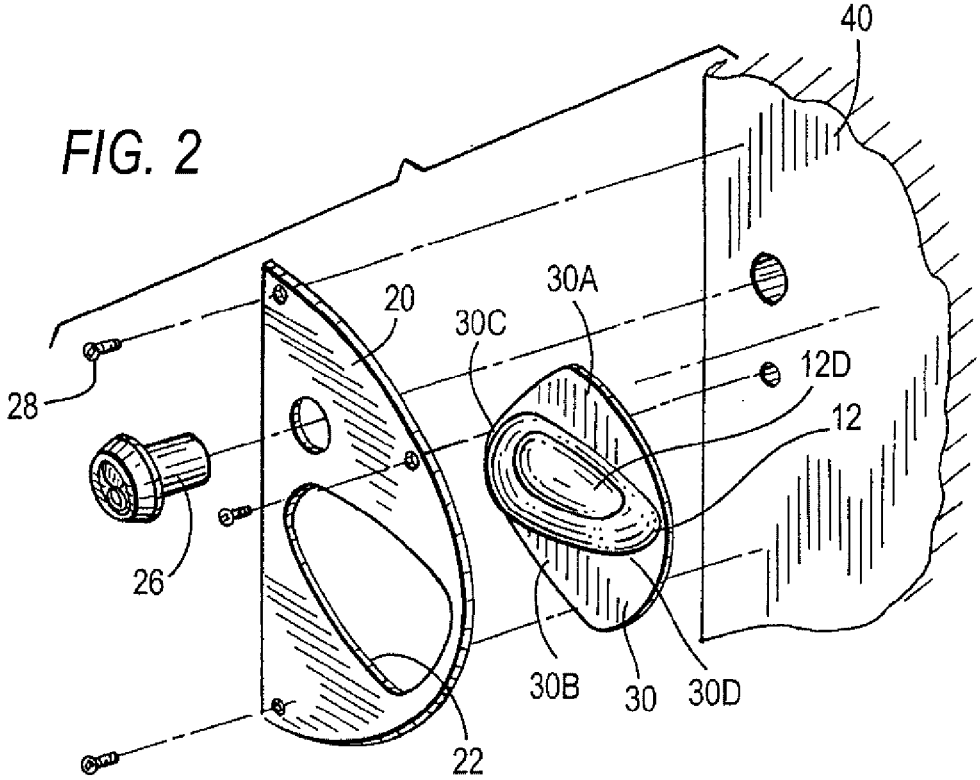
FIG. 2 is an exploded top and front perspective view of the new door lever assembly showing the components thereof.
Figure 4:
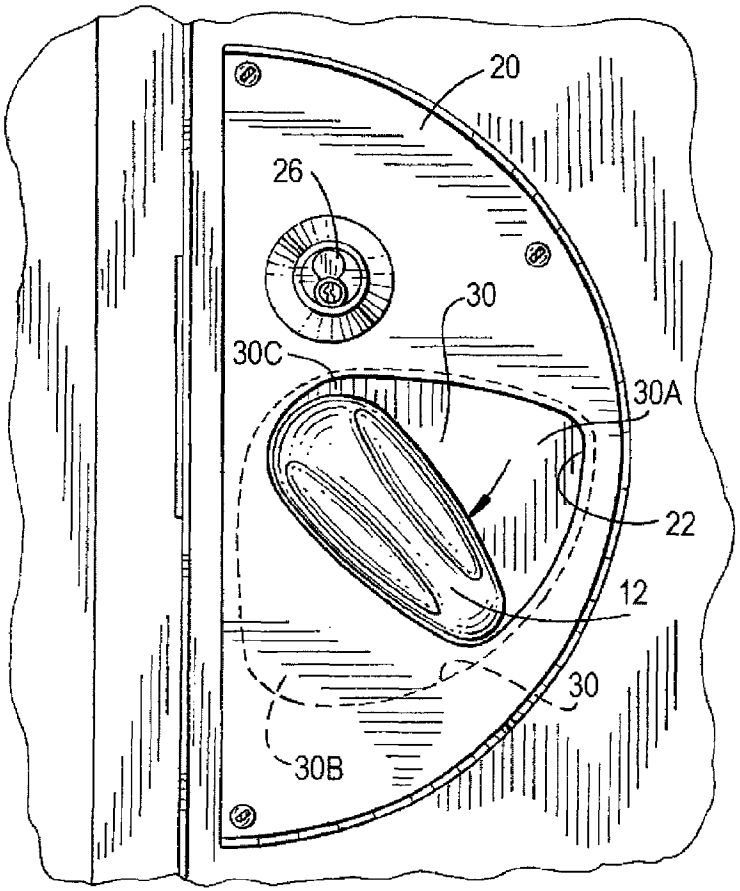
FIG. 4 is similar to FIG. 3 and shows the door lever pivoted to its downward inclined open or unlatched position.

The new door lever assembly 10 is shown in FIG. 1 as installed on door 40, and is shown in exploded view in FIG. 2. This door lever assembly comprises the basic components, lever 12, pivot plate 30 and face plate 20 mountable on the face of the door.

As best seen in FIGS. 1 and 5, lever 12, also called "mouse lever" because if its shape being generally similar to a computer mouse, has an elongated smooth humped top surface 13, a front end 14, tail end 16 and a flat bottom surface 17. Lever 12 is secured to pivot axle (or spindle) 18 by any conventional connection means 19 which may be pinned, splined, friction or interference fit, with the axle 18 coupled via a conventional door lock latch mechanism not shown to latch bolt 42 which can engage strike plate 43 seen in FIG. 3. The lever's mouse shape is smooth on front, tail and side surfaces, such that any ligature in contact with or wrapped about this lever, will quickly slide off, as there is no area about which a ligature can loop about and fixedly engage the lever.

FIGS. 1-6 show the new lever 12 having flat base surface 17, with pivot plate 30 fixed to base surface 17 that extends laterally as wide left and right flanges or wing portions 30A, 30B (see FIG. 2). Pivot plate 30 also extends as less wide flange portions 30C, 30D near the head and tail portions 14, 16 of lever 12.

The breadth or wing span of flanges 30A, 30B is substantially greater than the width of lever 12, so that when lever 12 is pivoted some parts of flange 30A, 30B are always underlying and covering window (aperture) 22 of face plate 20. With pivot plate 30 fixed to and pivoting with lever 12, there can be no gap between lever 12 and the door surface or between pivot plate 30 and face plate 20.

More specifically, pivot plate 30 is always beneath and closely underlying the face plate 20 and always covering window/aperture 22 of face plate 20. This is shown in greater detail in FIGS. 3-6 where flanges 30C, 30D at the head and tail parts of lever 12 are underlying adjacent portions of face plate 20.

Figure 3:
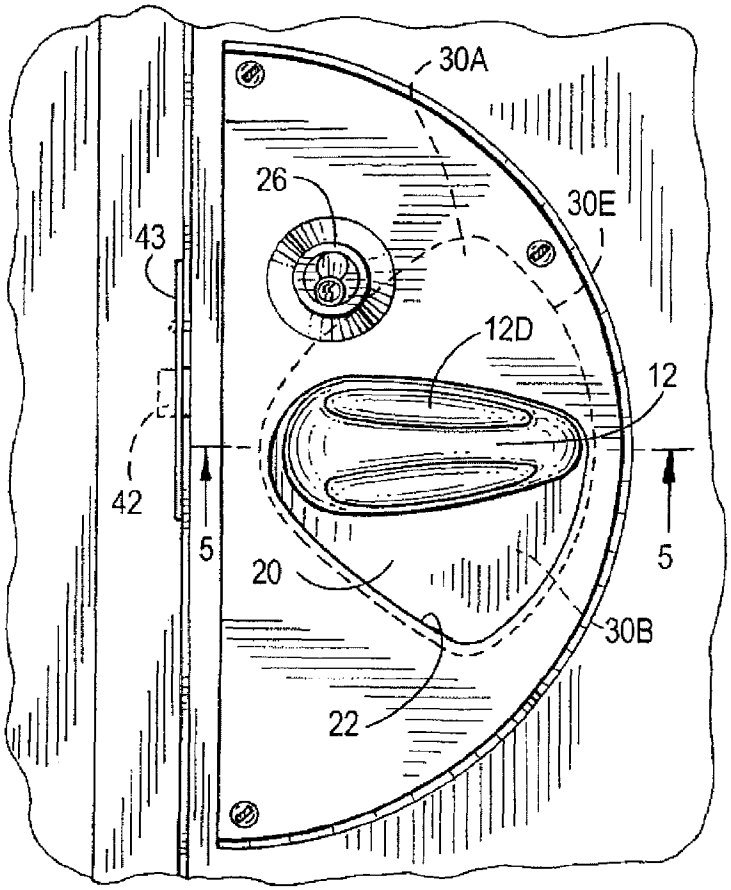
FIG. 3 is a front elevation view of the new door lever assembly mounted to a door and shown with the handle in its generally horizontal latched position.

In FIG. 3 the window 22 in face plate 20 (alternatively designated "mounting plate") appears in solid line, and pivot plate 30 which underlies window 22 has its peripheral edges shown in dashed-line 30E beneath pivot plate 30. In FIG. 3 lever 12 appears in its generally horizontal and position, and in FIG. 4 lever 12 is pivoted downward about 45° to its unlatched or open position at about 4:22 p.m. on a clock face.

In both latched and unlatched (open) positions pivot plate 30 has some portions of flanges 30A and 30B always beneath the periphery of window 22. FIG. 6 in bottom plan view: (a) shows lever 12 in dashed line in its horizontal or latched position, and (b) shows pivot plate 30 in solid line in its corresponding latched position, and (c) shows pivot plate 30 in its pivoted or unlatched position by dashed line 30E.

FIGS. 1-4 and 6 also show lock cylinder 26 which may be associated with the door latch mechanism in any conventional manner. Face plate 20 is secured to door 40 by conventional bolts 28. As noted above, pivot plate 30 is secured to the bottom of lever 12 by bolts not shown or adhesive, or other conventional means; lever axle or spindle 18 is releasably secured to lever 12 by spline or any conventional means.

Lever 12 may be further sculpted with inward depressions 12D as seen in FIGS. 1-5 to facilitate griping, which still does not provide any surface that can be engaged and secured to by a ligature.

Although the best mode for carrying out the present invention has been described in the foregoing detailed description and illustrated in the accompanying drawings, it will be understood that the invention is not limited to the embodiments enclosed, but is capable of numerous rearrangements, modifications and substitutions of steps and elements without departing from the spirit of the invention. Accordingly, the present invention is intended to encompass such rearrangements, modifications and substitutions of steps and elements as falls within the scope of the claims.

The invention claimed is:

1. A lever and mounting plate combination attachable to an exposed surface of a door that includes a latch assembly with a spindle extending outward from said surface, said lever and mounting plate combination comprising:

a. a mounting plate having top, bottom and opposite side edges and an inner face mountable onto said surface of said door and an outer face, each of said inner and outer faces defining an area, said mounting plate having an opening inward of said top, bottom and side edges and extending completely through said mounting plate, wherein said opening has an area that is less than said area defined by each of said inner and outer faces of said mounting plate, b. a lever (i) having a base part which is coupleable to said spindle such that pivoting of said lever causes rotation of said spindle, and (ii) having an exposed outer part, wherein said base part of said lever defines an area that is less than said area of said opening of said mounting plate and is pivotable within said opening of said mounting plate, and c. a lever plate having an outer face fixed to said base part of said lever and an opposite inner face facing said surface of said door, said lever plate being pivotable with said lever such that when said lever is pivoted, said lever pivots and simultaneously rotates said spindle to actuate said latch assembly, said lever plate having an area that is greater than said area of said opening, said lever plate situated between said inner face of said mounting plate and said surface of said door, and thus closely underlies said inner face of said mounting plate such that no portion of said surface of said door is visible through said opening at all pivotal positions of said lever plate.

2. The lever and mounting plate combination according to claim 1 wherein said lever has a latched position and is pivotable in a clockwise direction to an unlatched position.

3. The lever and mounting plate combination according to claim 1 wherein said lever has a generally oval shape having one end wider than the other.

4. The lever and mounting plate combination according to claim 3 wherein said generally oval shape has convex top and bottom edges.

5. The lever and mounting plate combination according to claim 1 wherein said lever has a shape that simulates a mouse with a convex rounded head end and a convex rounded tail end which is smaller than said head end, and has converging sides between said head and tail ends.

6. The lever and mounting plate combination according to claim 5 wherein said lever has a curved upper surface that tapers from said head end into said tail end in both side elevation views and in a top plan view of said lever.

7. The lever and mounting plate combination according to claim 6 wherein said lever has an exposed surface side portion with elongated inward recesses adapted to receive a user's thumb and finger tips for ease of pivoting said lever.

8. The lever and mounting plate combination according to claim 1 further comprising an aperture in said mounting plate through which is insertable a key lock cylinder.

9. The lever and mounting plate combination according to claim 1 wherein said lever is elongated with opposite head and tail ends and with said head end adapted to couple with said spindle.

* * * * *